US008512082B1

(12) United States Patent
Ku et al.

(10) Patent No.: US 8,512,082 B1
(45) Date of Patent: Aug. 20, 2013

(54) ELECTRICAL CONNECTOR JACK

(75) Inventors: Ying-Ming Ku, Taoyuan (TW); Chun-Chieh Chen, Taoyuan (TW); Shun-Fa Hung, Taoyuan (TW)

(73) Assignee: YFC-Boneagle Electric Co., Ltd., Taoyuan (TW)

( * ) Notice: Subject to any disclaimer, the term of this patent is extended or adjusted under 35 U.S.C. 154(b) by 0 days.

(21) Appl. No.: 13/370,592

(22) Filed: Feb. 10, 2012

(51) Int. Cl.
*H01R 24/00* (2011.01)

(52) U.S. Cl.
USPC ..... 439/676

(58) Field of Classification Search
USPC ..... 439/676, 941, 620.15, 76.1
See application file for complete search history.

(56) References Cited

U.S. PATENT DOCUMENTS 5,697,817 A * 12/1997 Bouchan et al. ..... 439/676
5,975,960 A * 11/1999 Fogg et al. ..... 439/676
6,165,023 A * 12/2000 Troutman et al. ..... 439/676
6,431,919 B1 * 8/2002 Wang et al. ..... 439/680
6,527,587 B1 * 3/2003 Ortega et al. ..... 439/607.05
6,629,862 B2 * 10/2003 Schmidt et al. ..... 439/676
6,994,594 B2 * 2/2006 Milner et al. ..... 439/676
7,090,542 B2 * 8/2006 Zheng et al. ..... 439/676
7,575,482 B1 * 8/2009 Pepe et al. ..... 439/676
RE41,250 E * 4/2010 Henneberger ..... 439/676
7,811,120 B2 * 10/2010 Liu ..... 439/490
8,070,529 B2 * 12/2011 Xiong et al. ..... 439/676
8,157,600 B2 * 4/2012 Ciezak et al. ..... 439/676
2005/0142952 A1 * 6/2005 Peng ..... 439/676

* cited by examiner

*Primary Examiner* — Alexander Gilman
(74) *Attorney, Agent, or Firm* — Chun-Ming Shih; HDLS IPR Services

(57) ABSTRACT

An electrical connector jack includes an insulation base, a separation piece, a first terminal group, a second terminal group, a third terminal group, and a fourth terminal group. The separation piece is provided in the insulation base. The first terminal group includes a first soldering end set located inside the separation piece. The second terminal group includes a second soldering end set located outside the separation piece. The third terminal group includes a third soldering end set located outside the separation piece. The fourth terminal group includes a fourth soldering end set located outside the separation piece.

8 Claims, 5 Drawing Sheets

ELECTRICAL CONNECTOR JACK

BACKGROUND OF THE INVENTION

1. Field of the Invention

The present invention relates to an electrical connector jack, and in particular to a network electrical connector jack which is capable of preventing against crosstalk.

2. Description of Prior Art

RJ45 connector jack is a network connector most widely used now, which includes a plastic base and eight terminals juxtaposed and embedded in the plastic base. In the conventional RJ45 connector jack, the terminals are arranged in two rows at one end of the plastic base. Since crosstalk is generated between two adjacent terminals to interfere other terminals, the impedance generated by each pair of terminals will interfere with each other to generate greater crosstalk, which deteriorates the quality of transmitting signals. Such a problem is more serious in transmitting signals at high frequencies.

SUMMARY OF THE INVENTION

The present invention is to provide an electrical connector jack, which is capable of preventing against crosstalk.

The present invention provides an electrical connector jack, which includes an insulation base, a separation piece, a first terminal group, a second terminal group, a third terminal group, and a fourth terminal group. The separation piece is a bent metallic shroud disposed in the insulation base. The first terminal group is partially embedded in the insulation base and comprises a first soldering end set. The first soldering end set is located inside the separation piece and protrudes from the interior to the outside of the insulation base. The second terminal group is partially embedded in the insulation base and comprises a second soldering end set. The second soldering end set is located outside the separation piece and protrudes from the interior to the outside of the insulation base. The third terminal group is partially embedded in the insulation base and comprises a third soldering end set. The third soldering end set is located outside the separation piece and protrudes from the interior to the outside of the insulation base. The fourth terminal group is partially embedded in the insulation base and comprises a fourth soldering end set. The fourth soldering end set is located outside the separation piece and protrudes from the interior to the outside of the insulation base.

Preferably, the insulation base comprises an insertion trough. The separation piece is formed into an inverted U shape. The separation piece comprises two opposite side plates and a top plate connected to the two side plates. The separation piece is disposed in the insertion trough. The second soldering end set is located outside the top plate. The third soldering end set is located outside one of the two side plates, and the fourth soldering end set is located outside the other of the two side plates.

Preferably, the separation piece comprises two L-shaped grounding legs. The two grounding legs extend from the two side plates and protrude outside the insulation base respectively.

Preferably, the first soldering end set, the third soldering end set, and the fourth soldering end set are arranged in parallel to the second soldering end set and juxtaposed in one row.

The present invention provides an electrical connector jack, which is capable of preventing against crosstalk, being connected with each other, and indicating its operating state by indicators.

In other to achieve the above objects, preferably, the electrical connector jack further includes an insulation housing. The insulation housing comprises two opposite side walls, a front wall vertically connected to the two side walls, a rear wall vertically connected to the two side walls and facing the front wall, and a bottom wall. The bottom wall is vertically connected to the two side walls, the front wall and the rear wall and located among the two side walls, the front wall and the rear wall. The insulation base is provided in the insulation housing and located inside the bottom wall. The two grounding legs of the separation piece extend from the two side plates and protrude from the insulation base to penetrate the bottom wall and protrude outside the insulation housing respectively. The bottom wall comprises at least one grounding hole. The grounding legs pass through the grounding hole to protrude outside the insulation housing. The insulation housing comprises a sliding groove and a guiding rail engaged with the sliding groove. The guiding rail and the sliding groove are provided outside the two side walls respectively. The insulation housing comprises a light-guiding hole extending from the front wall to the rear wall to penetrate the insulation housing. The electrical connector jack further comprises a light-guiding post disposed in the light-guiding hole.

In the present invention, the first soldering end set, the second soldering end set, the third soldering end set, and the fourth soldering end set are separated from each other by the separation piece, so that the noise generated by the terminal groups can be prevented from interfering with each other to form crosstalk. The sliding groove and the guiding rail provided on the insulation housing allow a plurality of electrical connector jacks to be connected with each other, so that the number of fasteners provided on each electrical connector jack can be reduced. Further, the light-guiding post in the insulation housing can indicate the operating state of the electrical connector jack. By this structure, the present invention can solve the problems in prior art.

DETAILED DESCRIPTION OF THE INVENTION

Figure 1:
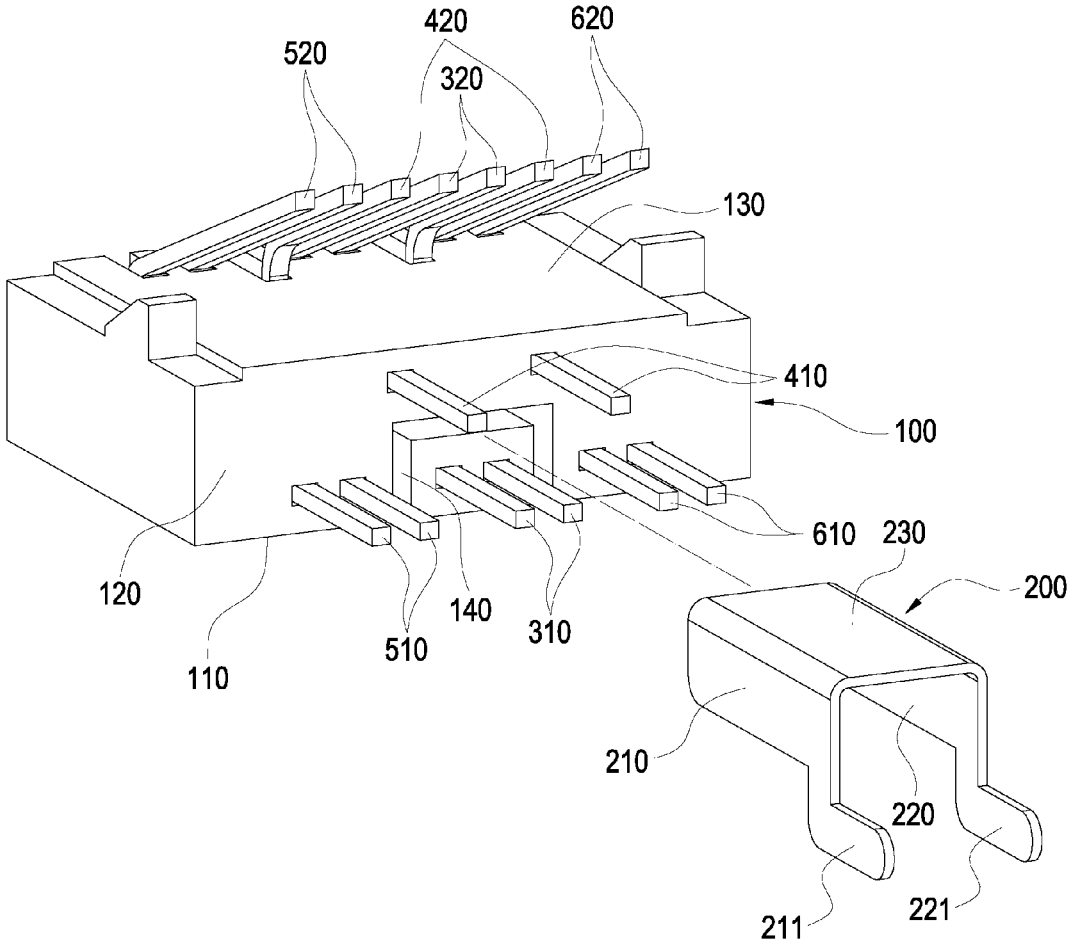
FIG. 1 is an exploded perspective view showing the electrical connector jack according to a first embodiment of the present invention.
Figure 2:
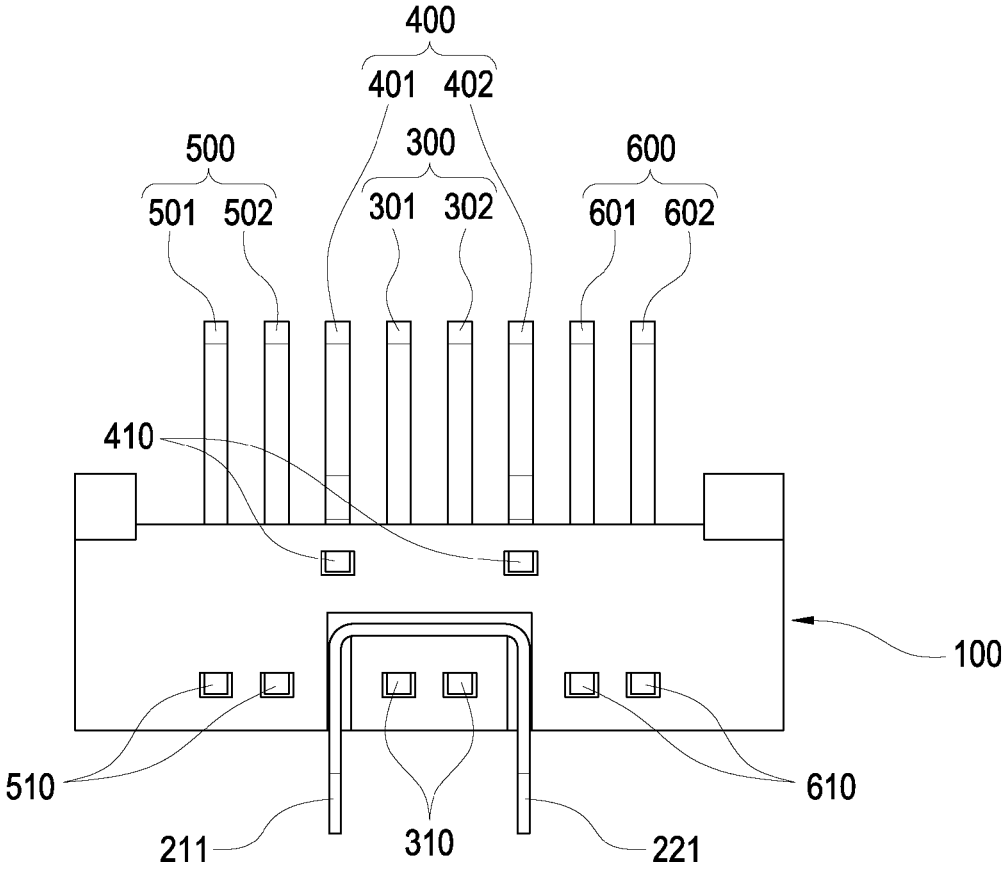
FIG. 2 is a rear view showing the electrical connector jack according to the first embodiment of the present invention.

Please refer to FIGS. 1 and 2. The present invention provides an electrical connector jack, which is configured to allow a corresponding electrical connector plug to be inserted therein. In the first embodiment of the present invention, the electrical connector jack of the present invention includes an insulation base 100, a separation piece 200, a first terminal group 300, a second terminal group 400, a third terminal group 500, and a fourth terminal group 600.

The insulation base 100 is preferably made of plastic materials. The separation piece 200 is a bent metallic shroud having an inverted U shape (preferably made of stainless steel piece). The profile and size of the separation piece 200 is smaller than those of the insulation base 100. Preferably, the separation piece 200 is embedded in the insulation base 100 by an injection molding process. Alternatively, a rear surface 120 of the insulation base 100 is provided with an insertion trough 140, and the separation piece 200 is inserted into the insertion trough 140. The separation piece 200 comprises two opposite side plates 210/220 and a top plate 230 connected to the two side plates 210/220. Two grounding legs 211/221 extend from the two side plates 210/220 respectively to be electrically connected to the ground. In the present embodiment, the grounding leg 211 extends from the side plate 210, and the grounding leg 221 extends from the side plate 220. The grounding legs 211/221 protrude downwardly from the bottom surface 110 of the insulation base 100. Preferably, the grounding legs 211/221 extend vertically and rearwards from the rear surface 120 of the insulation base 100 to form an L-shaped leg respectively. The grounding leg 211/221 may protrude from the rear surface 120 of the insulation base 100, but they are not limited thereto.

The first terminal group 300 is a pair of elongate bent golden pins that are juxtaposed in parallel to each other. Each golden pin is preferably bent on a plane. Both ends of the first terminal group 300 are a first soldering end set 310 and a first contact end set 320. In the present embodiment, the middle section of the first terminal group 300 is embedded in the insulation base 100. The first soldering end set 310 is located inside the separation piece 200 and protrudes rearwards from the interior of the insulation base 100 to the outside of the rear surface 120 of the insulation base 100. Alternatively, the first soldering end set 310 may protrude downwardly from the bottom surface 110 of the insulation base 100, but it is not limited thereto. The first contact end set 320 of each golden pin extends from the first soldering end set 310 to penetrate the insulation base 100 and protrude upwardly outside the top surface 130 of the insulation base 100.

The second terminal group 400 is a pair of elongate bent golden pins that are juxtaposed in parallel to each other. Each golden pin is preferably bent on a plane. Both ends of the second terminal group 400 are a second soldering end set 410 and a second contact end set 420. In the present embodiment, the middle section of the second terminal group 400 is embedded in the insulation base 100. The second soldering end set 410 is located outside of the top plate 230 of the separation piece 200 and protrudes rearwards from the interior of the insulation base 100 to the outside of the rear surface 120 of the insulation base 100. Alternatively, the second soldering end set 410 may protrude downwardly from the bottom surface 110 of the insulation base 100, but it is not limited thereto. The second contact end set 420 extends from the second soldering end set 410 to penetrate the insulation base 100 and protrude upwardly outside the top surface 130 of the insulation base 100.

The third terminal group 500 is a pair of elongate bent golden pins that are juxtaposed in parallel to each other. Each golden pin is preferably bent on a plane. Both ends of the third terminal group 500 are a third soldering end set 510 and a third contact end set 520. In the present embodiment, the middle section of the third terminal group 500 is embedded in the insulation base 100. The third soldering end set 510 is located outside one side plate 210 of the separation piece 200 and protrudes rearwards from the interior of the insulation base 100 to the outside of the rear surface 120 of the insulation base 100. Alternatively, the third soldering end set 510 may protrude downwardly from the bottom surface 110 of the insulation base 100, but it is not limited thereto. The third contact end set 520 extends from the third soldering end set 510 to penetrate the insulation base 100 and protrude upwardly outside the top surface 130 of the insulation base 100.

The fourth terminal group 600 is a pair of elongate bent golden pins that are juxtaposed in parallel to each other. Each golden pin is preferably bent on a plane. Both ends of the fourth terminal group 600 are a fourth soldering end set 610 and a fourth contact end set 620. In the present embodiment, the middle section of the fourth terminal group 600 is embedded in the insulation base 100. The fourth soldering end set 610 is located outside the other side plate 220 of the separation piece 200 and protrudes rearwards from the interior of the insulation base 100 to the outside of the rear surface 120 of the insulation base 100. Alternatively, the fourth soldering end set 610 may protrude downwardly from the bottom surface 110 of the insulation base 100, but it is not limited thereto. The fourth contact end set 620 extends from the fourth soldering end set 610 to penetrate the insulation base 100 and protrude upwardly outside the top surface 130 of the insulation base 100.

In the present embodiment, the first terminal group 300 is preferably a pair of golden pins including a #4 terminal 301 and a #5 terminal 302 juxtaposed in parallel to each other. The second terminal group 400 is preferably a pair of golden pins including a #3 terminal 401 and a #6 terminal 402 juxtaposed in parallel to each other. The third terminal group 500 is preferably a pair of golden pins including a #1 terminal 501 and a #2 terminal 502 juxtaposed in parallel to each other. The fourth terminal group 600 is preferably a pair of golden pins including a #7 terminal 601 and a #8 terminal 602 juxtaposed in parallel to each other. The #1 to #8 terminals 301/302/401/402/501/502/601/602 are juxtaposed in parallel to each other on the insulation base 100 at equal internals.

The first contact end set 320, the second contact end set 420, the third contact end set 520, and the fourth contact end set 620 are juxtaposed in the insulation base 100 to become one row and protrude upwards from the top surface 130 of the insulation base 100, thereby electrically connecting to a corresponding electrical connector plug. The second soldering end set 410 is arranged to be adjacent to the top surface 130 of the insulation base 100. The first soldering end set 310, the third soldering end set 510 and the fourth soldering end set 610 are arranged in parallel to the second soldering end set 410 to become one row and disposed adjacent to the bottom surface 110 of the insulation base 100.

In the electrical connector jack of the present invention, the inverted U-shaped metallic separation piece 200 is used to separate the first soldering end set 310 from the second soldering end set 410, the third soldering end set 510 and the fourth soldering end set 610. The first soldering end set 310 is located inside the separation piece 200. The separation piece 200 generates a screening effect, so that the first soldering end set 310 cannot interference with the second soldering end set 410, the third soldering end set 510 and the fourth soldering end set 610 outside the separation piece 200. The second soldering end set 210 is arranged near the top surface 120 of the insulation base 100 and separated from the third soldering end set 510 and the fourth soldering end set 610 near the bottom surface 110. The separation piece 200 is used to separate the third soldering end set 510 and the fourth soldering end set 610. The intervals among the second soldering end set 410, the third soldering end set 510 and the fourth soldering end set 610 are larger than those of the prior art, thereby reducing the noise interference among them. Further, the noise generated by the second soldering end set 410, the third soldering end set 510 and the fourth soldering end set 610 will be absorbed by the separation piece 200 from the top plate 230 and the two side plates 210/220 and released to the ground via the two grounding legs 211/221.

Figure 3:
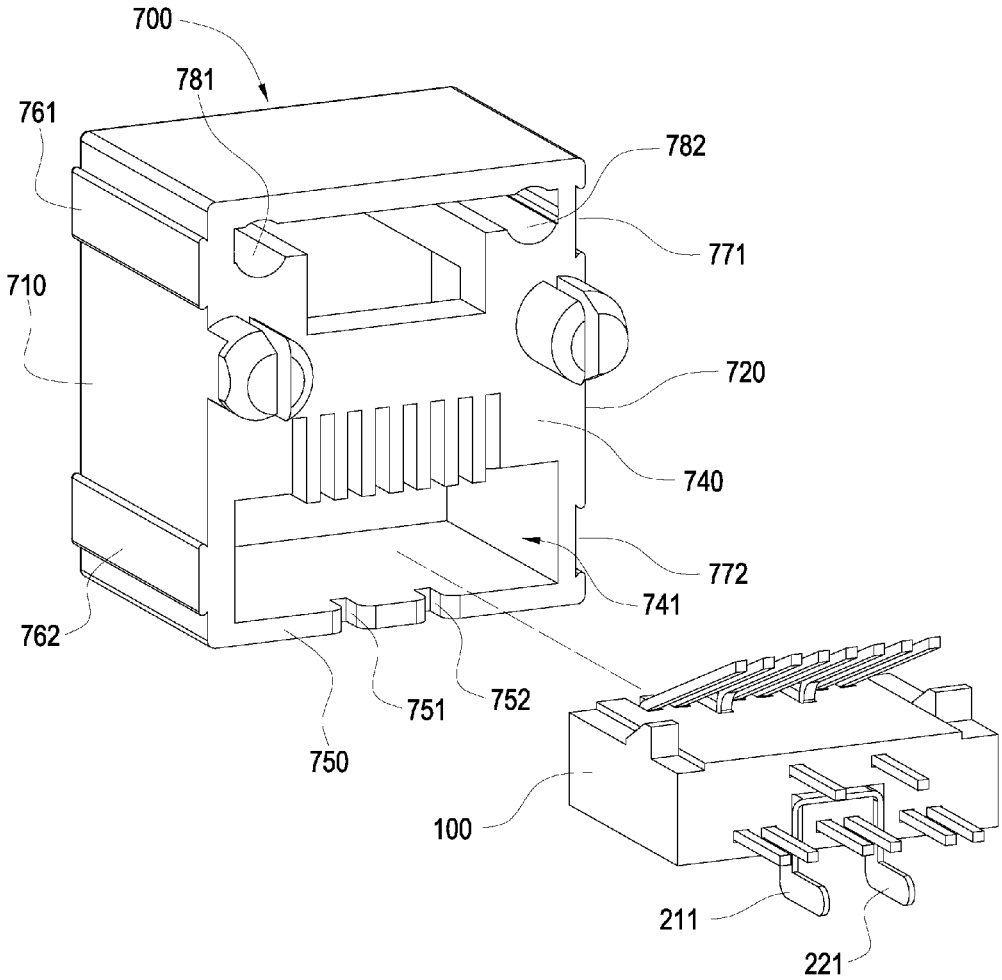
FIG. 3 is an exploded perspective view showing the electrical connector jack according to a second embodiment of the present invention.
Figure 4:
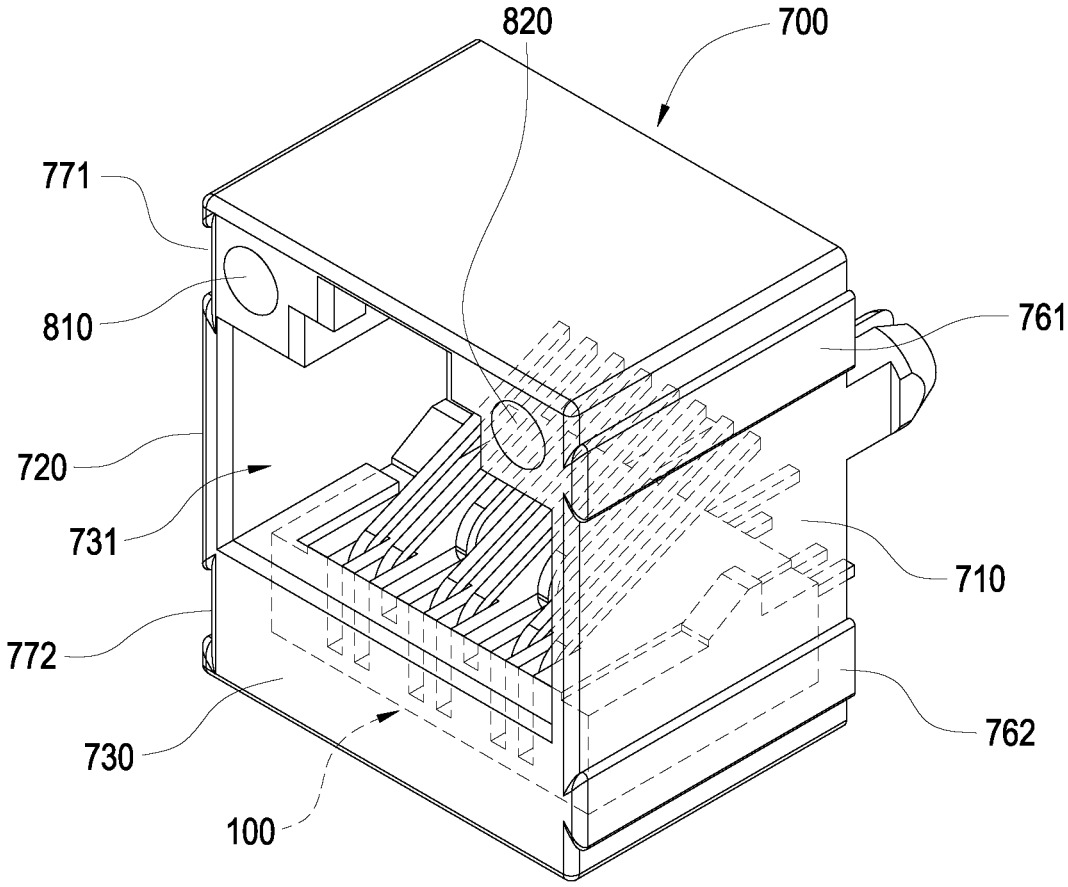
FIG. 4 is a schematic front view showing the external appearance of the electrical connector jack according to the second embodiment of the present invention.
Figure 5:
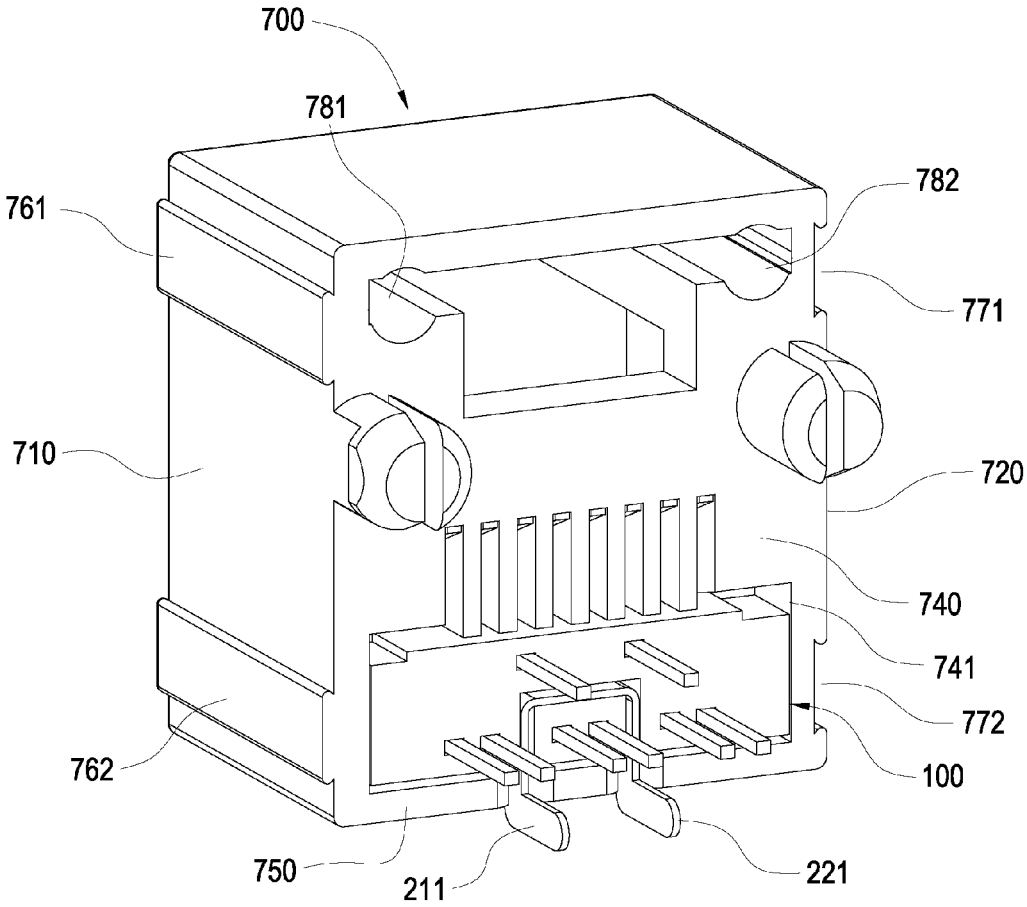
FIG. 5 is a schematic rear view showing the external appearance of the electrical connector jack according to the second embodiment of the present invention.

Please refer to FIGS. 3 to 5, which show the second embodiment of the present invention. The present invention provides an electrical connector jack, which is configured to allow a corresponding electrical connector plug to be inserted therein. The electrical connector jack of the present embodiment includes an insulation housing 700, an insulation base 100, a separation piece 200, a first terminal group 300, a second terminal group 400, a third terminal group 500, a fourth terminal group 600, and two light-guiding posts 810/820. The insulation base 100 is preferably made of plastic materials.

The insulation housing 700 is formed into a hollow hexahedron body comprising two side walls 710/720, a front wall 730, a rear wall 740, and a bottom wall 750. The two side walls 710/720 are provided to face each other. The front wall 730 is vertically connected to the two side walls 710/720. The front wall 730 is provided with an insertion port 731 for allowing the corresponding electrical connector plug to be inserted therein. The rear wall 740 is provided to face the front wall 730 and is also vertically connected to the two side walls 710/720. The rear wall 740 is provided with a mounting port 741 for allowing the insulation base 100 to be disposed in the insulation housing 700. The bottom wall 750 is vertically connected to the two side walls 710/720, the front wall 730 and the rear wall 740 and located among the two side walls 710/720, the front wall 730 and the rear wall 740. The bottom wall 750 is provided with two grounding holes 751/752. The insulation base 100 is disposed into the insulation housing 700 via the mounting port 741 to be disposed inside the bottom wall 750.

The insulation housing 700 further comprises a sliding groove 771(772) and a corresponding guiding rail 761(762). The guiding rail 761(762) can be engaged in a corresponding sliding groove 771(772). In the present invention, the number of the sliding groove 771/772 and the guiding rail 761/762 is not limited thereto. In the present embodiment, the insulation housing 700 preferably comprises two sliding grooves 771/772 and two guiding rails 761/762. Each guiding rail 761(762) and the corresponding sliding groove 771(772) are provided outside the two side walls 710(720) respectively. In the present embodiment, the two guiding rails 761/762 are provided on the same side wall 710, while the two sliding grooves 771/772 are provided on the same side wall 720. Alternatively, all of the guiding rails 761/762 may be provided on the same side wall 710(720), or all of the sliding grooves 771/772 may be provided on the same side wall 720(710). When there are a plurality of electrical connector jacks, these plurality of electrical connector jacks of the present invention can be combined with each other via the engagement between the sliding grooves 771(772) and the guiding rails 761(762), so that the number of fasteners provided on each electrical connector jack can be reduced.

The insulation housing 700 further comprises light-guiding holes 781/782. The light-guiding holes 781/782 extend from the front wall 730 to the rear wall 740 to penetrate the insulation housing 700. In the present embodiment, the insulation housing 700 preferably comprises two light-guiding holes 781/782. However, the number of the light-guiding holes 781/782 is not limited thereto.

In the present embodiment, the relationship of structure and connection among the insulation base 100, the separation piece 200, the first terminal group 300, the second terminal group 400, the third terminal group 500, and the fourth terminal group 600 of the second embodiment are substantially the same as those of the first embodiment, so that the redundant description thereof is omitted for simplicity. However, the grounding leg 211 extends from the side plate 210, and the grounding leg 221 extends from the side plate 220. Each grounding leg 211(221) protrudes from the insulation base 100 to penetrate the bottom wall 750 via the grounding hole 751(752) and to protrude outside the insulation housing 700.

In the present embodiment, the electrical connector jack comprises two light-guiding posts 810(820) disposed in the two light-guiding holes 781(782) of the insulation housing 700 respectively. However, the number of the light-guiding post 810/820 of the present invention is not limited thereto. The light-guiding post 810(820) is configured to guide the light emitted from a light source outside the rear wall 740 to the front wall 730 via the light-guiding hole 781(782). The light source may be an indicator for indicating the operating state of the electrical connector jack, but it is not limited thereto. In the present embodiment, preferably, two light-guiding posts 810/820 are provided for guiding the light emitted from two light sources to the front wall 730.

The electrical connector jack of the present invention prevents against the crosstalk by providing intervals among the terminal groups. Further, the screening effect of the separation piece 200 screens the noise, and the grounding legs 211/221 release the noise. Thus, the present invention can solve the problems in prior art.

Although the present invention has been described with reference to the foregoing preferred embodiments, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. An electrical connector jack, including:

an insulation housing;

an insulation base provided inside the insulation housing and disposed on a bottom wall of the insulation housing;

a single separation piece provided in the insulation base and being a bent metallic shroud;

a first terminal group partially embedded in the insulation base for transmitting first signals, the first terminal group comprising a first soldering end set, the first soldering end set being located inside the separation piece and protruding from the interior to the outside of the insulation base;

a second terminal group partially embedded in the insulation base for transmitting second signals, the second terminal group comprising a second soldering end set, the second soldering end set being located outside the separation piece and protruding from the interior to the outside of the insulation base;

a third terminal group partially embedded in the insulation base for transmitting third signals, the third terminal group comprising a third soldering end set, the third soldering end set being located outside the separation piece and protruding from the interior to the outside of the insulation base; and a fourth terminal group partially embedded in the insulation base for transmitting forth signals, the fourth terminal group comprising a fourth soldering end set, the fourth soldering end set being located outside the separation piece and protruding from the interior to the outside of the insulation base, wherein the separation piece has an inverted U shape and is formed by two opposite side plates and one top plate connected between two side plates to enclose but not touch the first soldering end set inside the separation piece, the second soldering end set is located outside the separation piece and above but not touch the top plate, the third soldering end set is located outside the separation piece and beside but not touch one of the side plates, and the fourth soldering end set is located outside the separation piece and beside but not touch the other one of the side plates, wherein the separation piece further comprises two grounding legs extending from the two side plates respectively and protrude out of the insulation base to penetrate the bottom wall and protrude out of the insulation housing.

2. The electrical connector jack according to claim 1, wherein the insulation base comprises an insertion trough, and the separation piece is provided in the insertion trough of insulation base.

3. The electrical connector jack according to claim 1, wherein the first soldering end set, the third soldering end set, and the fourth end set are arranged in parallel to the second soldering end set and are juxtaposed in one row.

4. The electrical connector jack according to claim 1, wherein the insulation housing comprise two opposite side walls, a front wall vertically connected to the two side walls, a rear wall vertically connected to the two side walls and facing the front wall, and the bottom wall vertically connected to the two side walls and the front wall.

5. The electrical connector jack according to claim 1, wherein the bottom wall comprises at least one grounding hole, the grounding leg passes through the grounding hole to protrude out of the insulation housing.

6. The electrical connector jack according to claim 1, wherein the insulation housing comprises a sliding groove and a guiding rail engaged with the sliding groove, the guiding rail and the sliding groove are provided outside the two side walls respectively.

7. The electrical connector jack according to claim 1, wherein the insulation housing comprises a light-guiding hole extending from the front wall to the rear wall to penetrate the insulation housing.

8. The electrical connector jack according to claim 7, further including a light-guiding post disposed in the light-guiding hole.

* * * * *